United States Patent [19]

Gasser et al.

[11] Patent Number: 4,967,946

[45] Date of Patent: Nov. 6, 1990

[54] PNEUMATIC PIPE CONVEYOR INSTALLATION FOR FIBRES

[75] Inventors: Hermann Gasser, Frauenfeld; Karl Curiger, Pfäffikon; Hans Rutz, Winterhur, all of Switzerland

[73] Assignee: Hollingsworth GmbH, Fed. Rep. of Germany

[21] Appl. No.: 214,945

[22] Filed: Jul. 5, 1988

[30] Foreign Application Priority Data

Jul. 9, 1987 [DE] Fed. Rep. of Germany ..... 3722773

[51] Int. Cl.[5] ..... B65H 63/00; D01H 5/60

[52] U.S. Cl. ..... 226/25; 226/45; 19/263; 57/305

[58] Field of Search ..... 226/24, 43, 45, 97, 226/25; 57/304, 305; 19/263; 28/255

[56] References Cited

U.S. PATENT DOCUMENTS

| | | | |
|---|---|---|---|
| 2,333,267 | 11/1943 | Modigliani | 226/97 X |
| 2,577,915 | 12/1951 | Piller et al. | 226/97 X |
| 3,203,634 | 8/1965 | Fürst | 57/305 X |
| 3,640,440 | 2/1972 | Sedlarik et al. | 226/34 |
| 3,722,733 | 3/1973 | Plate et al. | 226/25 |
| 3,747,818 | 7/1973 | Winkler | 226/45 X |
| 4,300,711 | 11/1981 | Sutter et al. | 226/97 |
| 4,676,443 | 6/1987 | Simmons | 226/43 X |
| 4,829,640 | 5/1989 | Greb et al. | 28/255 |

FOREIGN PATENT DOCUMENTS

| | | | |
|---|---|---|---|
| 511179 | 8/1971 | Switzerland . | |
| 400634 | 5/1974 | U.S.S.R. | 19/263 |
| 1321809 | 7/1973 | United Kingdom . | |

*Primary Examiner*—Daniel P. Stodola
*Assistant Examiner*—Paul Thomas Bowen
*Attorney, Agent, or Firm*—Townsend and Townsend

[57] ABSTRACT

Known pneumatic pipe conveyor installations for fibres, particularly for textile fibre strands, comprise a conveyor pipe and a selectively operable feeder apparatus for feeding the fibres to the inlet opening of the conveyor pipe.

For permitting the feeder apparatus to be automatically stopped in response to the formation of a fibre congestion adjacent the inlet opening of the conveyor pipe, there is provided a pressure-receiving surface (6) at least partially surrounding the inlet opening (5) of the conveyor pipe (2) and operatively connected to a switch (7) adapted to generate a stop signal for stopping operation of the feeder apparatus (3) in response to the pressure acting on the pressure-receiving surface (6) exceeding a predetermined value.

The pneumatic pipe conveyor installation is useful for conveying fibre strands or slubbings in the textile industry.

10 Claims, 1 Drawing Sheet

PNEUMATIC PIPE CONVEYOR INSTALLATION FOR FIBRES

Figures 1, 2:
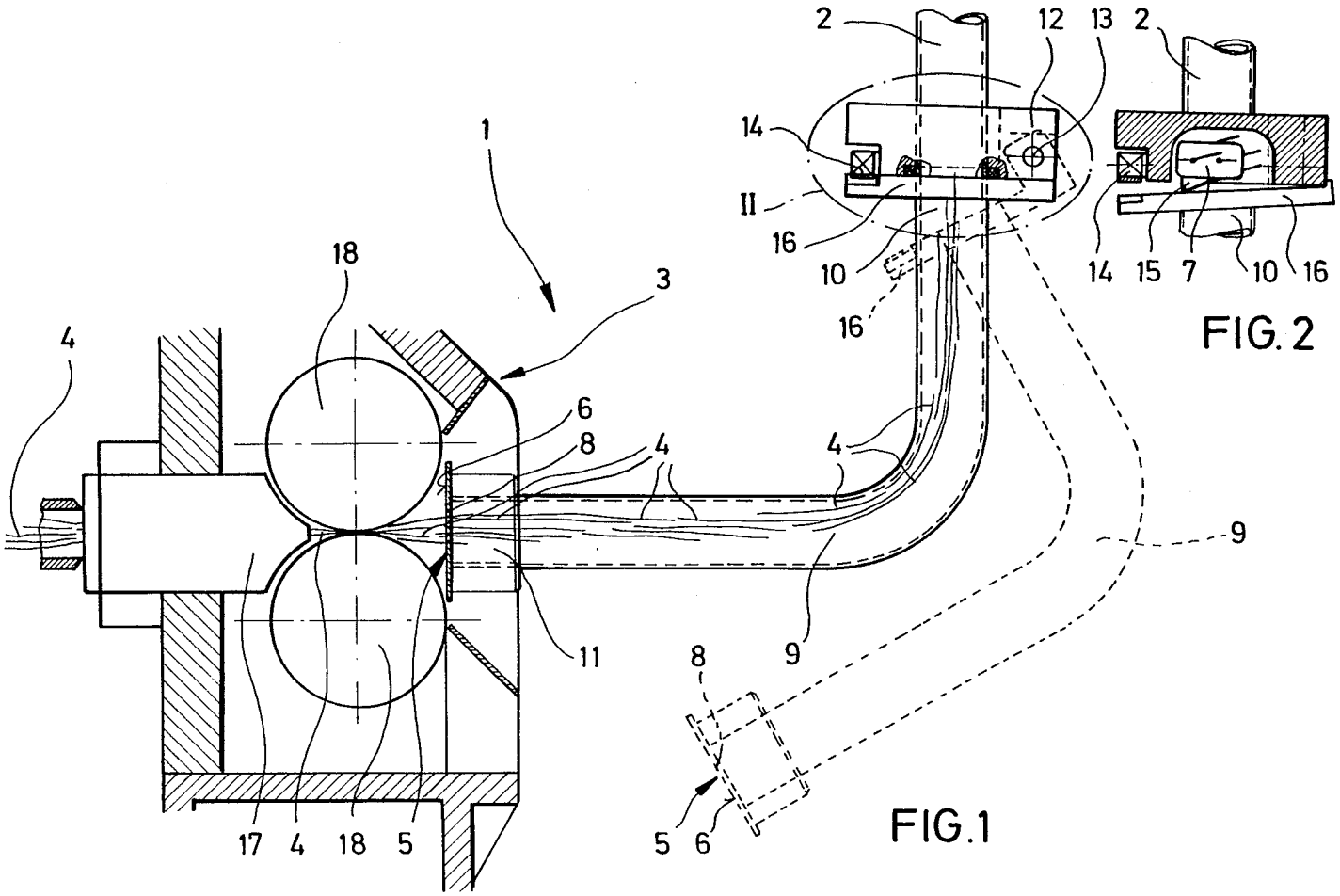

Pneumatic pipes conveyor installations are employed for conveying fibre materials, particularly textile fibre strands. They comprise a conveyor pipe and a feeder apparatus for feeding the fibre material to an inlet opening of the conveyor pipe.

As the fibre material or fibre strand is being fed to the inlet opening of the conveyor pipe, it may happen that a fibre congestion is formed, resulting in stoppage of the pipe conveyor installation. In this case the feeder apparatus has to be stopped as soon as possible, to prevent the congestion at the inlet opening of the conveyor pipe from causing further congestions or other malfunctions throughout the conveyor installation.

It is therefore an object of the present invention to improve a pneumatic pipe conveyor installation of the type defined above in such a manner that the feeder apparatus is automatically stopped in response to the occurrence of a congestion at the inlet opening of the conveyor pipe to thereby avoid the occurrence of further congestions.

Since the inlet opening of the conveyor pipe is at least partially surrounded by a pressure-receiving surface, the formation of a congestion adjacent the inlet opening of the conveyor pipe will result in a pressure being exerted on the pressure-receiving surface. The increase of this pressure above a predetermined value causes a stop signal to be generated for immediately stopping the operation of the feeder apparatus. This results in the occurrence of congestions within the feeder apparatus and upstream thereof being avoided, so that the operation of the installation can be restarted after removal of the fibre congestion at the inlet opening of the conveyor pipe.

According to a preferred embodiment, the pressure-receiving surface is formed on a pressure-receiving plate adjacent the inlet opening of the conveyor pipe. In this manner it is automatically ensured that the pressure-receiving surface is always positioned at the congestion-prone location when the conveyor installation is set up for operation.

It is preferred to form the pressure-receiving plate as an annular flange surrounding the inlet opening of the conveyor pipe, so that the formation of a fibre congestion causes the feeder apparatus to be switched off even if the congestion only forms at a restricted location of the inlet opening.

In a preferred embodiment the invention provides that the pressure-receiving surface is mounted on a component adapted to yield to a pressure acting on the pressure-receiving surface. This results in the advantage that a fibre congestion forming adjacent the inlet opening of the conveyor pipe and acting on said pressure-receiving surface not only causes the feeder apparatus to be immediately switched off, but also that the rearwards propagation of the congestion towards the feeder apparatus is avoided, because the component carrying the pressure-receiving surface is capable of yielding so as to increase the volume available for the fibre congestion.

In a particularly preferred embodiment of the invention, the conveyor pipe comprises an elbow portion having a connection end hingedly connected to the remainder of the conveyor pipe. In this embodiment, the inlet opening of the conveyor pipe facing the feeder apparatus is provided at the other end of the elbow portion. The occurrence of a fibre congestion does not only result in the operation of the feeder apparatus being stopped, but also in the elbow portion being pivotally displaced in response to the pressure exceeding a predetermined value. As a result, the inlet opening is arcuately displaced from its former position facing the feeder apparatus, so that the congestion upstream of the inlet opening of the conveyor pipe may even disentangle itself without external intervention. In this case it is only required to pivot the elbow portion back to its operative position for subsequently restarting the operation of the conveyor installation.

It is advantageous to provide the connection end of the elbow portion with a pivot hinge having a substantially vertical pivot axis at a laterally spaced location from the inlet opening. The vertical alignment of the pivot axis permits the influence of gravity to be neglected. The lateral spacing of the pivot axis from the inlet opening of the elbow portion ensures that the formation of a fibre congestion results in a force acting on the pivot hinge in a direction causing the elbow portion to pivot away from its operative position.

According to a preferred embodiment, the elbow portion is disposed in a substantially horizontal plane.

It is preferred that the elbow portion encloses a substantially right angle. On occurrence of a fibre congestion, this provision results in the exertion on the pivot hinge of the strongest possible opening force, so that the elbow portion pivots easily and rapidly in response to the pressure exerted by the fibre congestion exceeding the predetermined value.

According to a particularly advantageous aspect, the side of the connection end of the elbow portion located substantially diametrally opposite the pivot axis is provided with lock means adapted to open in response to a pressure acting on the pressure-receiving plate. This lock means permits the predetermined pressure limit value to be set in a simple manner.

In a particularly simple arrangement, the locking means is of the magnetic type employing a solenoid or a permanent magnet. The desired pressure limit value may then be determined by selecting the force of the magnet.

As provided by a particularly advantageous embodiment of the invention, the switch for stopping operation of the feeder apparatus is mounted on the connection end of the elbow portion. In this embodiment the switch is formed as a push switch operable by the pivot movement of the elbow portion. As a result, the operation of the feeder apparatus is stopped simultaneously with the opening displacement of the elbow portion. This opening displacement of the elbow portion permits the fibre congestion to expand and/or to be cleared, while a continued growth of the congestion is at the same time avoided.

According to an embodiment, the feeder apparatus comprises a blow nozzle for blowing the fibre strand into the inlet opening of the conveyor pipe, the blow nozzle being disposed upstream of the inlet opening of the conveyor pipe substantially in axial alignment therewith. This method of blowing the fibres into the inlet opening of the conveyor pipe is helpful for avoiding the formation of a fibre congestion at the outset.

It is also advantageous that the feeder apparatus includes a calender roller pair disposed between the blow nozzle and the inlet opening of the conveyor pipe. The calender roller pair acts to compact the fibres, so that they occupy a smaller space within the conveyor pipe, resulting in a still further reduction of the danger of congestion.

An embodiment of the invention shall now be described by way of example with reference to the accompanying drawings, wherein:

FIG. 1 shows a diagrammatical top plan view of a pneumatic pipe conveyor installation according to the invention, and FIG. 2 shows a horizontal section view of a detail designated II in FIG. 1.

As shown in the drawings, a pneumatic pipe conveyor installation 1 for fibre material, particularly a textile fibre strand, comprises a conveyor pipe 2 and a selectively operable feeder apparatus 3 for feeding the fibre material or fibre strand 4 to the inlet opening 5 of the conveyor pipe.

As clearly shown in FIG. 1, inlet opening 5 of conveyor pipe 2 is at least partially surrounded by a pressure-receiving surface 6 operatively connected to a switch 7 for stopping the operation of feeder apparatus 3 by the generation of a stop signal in response to a pressure acting on pressure-receiving surface 6 exceeding a predetermined limit value (of. also FIG. 2).

Pressure-receiving surface 6 is formed on a pressure-receiving plate 8 in the form of an annular flange surrounding inlet opening 5 of conveyor pipe 2. In other words, and more particularly, pressure-receiving surface 6 is disposed on a component adapted to yield to a pressure acting on the pressure-receiving surface.

In the embodiment shown, the yielding component is an elbow portion 9 of conveyor pipe 2. Elbow portion 9 has a connection end 10 hingedly connected to the remainder of conveyor pipe 2, its other end 11 being formed with the inlet opening 5 of the conveyor pipe facing feeder apparatus 3.

As clearly evident from FIG. 1, connection end 10 of elbow portion 9 is provided with a pivot hinge 12 having a substantially vertical pivot axis 13 at a lateral spacing from inlet opening 5.

Elbow portion 9 itself is disposed in a substantially horizontal plane with both of its legs. It is also clearly shown that elbow portion 9 encloses a substantially right angle.

At a location substantially diametrically opposite pivot axis 13, connection end 10 of elbow portion 9 is provided with lock means 14 adapted to be released by a pressure acting on pressure plate 8. In the embodiment shown, lock means 14 comprises a permanent magnet.

As shown in FIG. 2, connection end 10 of elbow portion 9 further carries a switch 7 for stopping operation of feeder apparatus 3. Switch 7 is a push switch operable by the pivoting movement of elbow portion 9. To this purpose switch 7 has an actuator pin 15 adapted to be operatively engaged by a flange 16 secured to connection end 10 and additionally carrying a complementary component of magnetic lock means 14.

As further evident from the diagrammatic top plan view shown in FIG. 1, feeder apparatus 3 comprises a blow nozzle 17 for blowing the fibre material or fibre strand 4 into inlet opening 5 of conveyor pipe 2. Blow nozzle 17 is disposed upstream of inlet opening 5 of conveyor pipe 2 and substantially in axial alignment therewith, at least in the operative position thereof as shown by solid lines in the figure.

Feeder apparatus 3 further includes a calender roller pair 18 disposed between blow nozzle 17 and inlet opening 5 of conveyor pipe 2.

The pipe conveyor installation 1 according to the invention operates as follows:

Blow nozzle 17 is connected to a compressed-air source (not shown in the drawings) and operable to blow the fibre material or fibre strand 4 into inlet opening 5 of elbow portion 9 through the gap formed between calender rollers 18. In normal operation of the installation, fibre strand 4 is then conveyed further through elbow portion 9 and the remainder of conveyor pipe 2.

In the case of a fibre congestion forming for any of a plurality of reasons adjacent inlet opening 5 of conveyor pipe 2, the fibre material or fibre strand 4 accumulates between calender rollers 18 and pressure-receiving plate 8. This fibre accumulation is backed up by calender rollers 18 to exert a pressure on pressure-receiving plate 8. This results in a force being exerted on elbow portion 9 tending to pivot it about pivot axis 13.

When the thus exerted pressure exceeds a predetermined limit value, magnetic lock means 14 is no longer able to oppose the force about pivot axis 13. As a result, elbow portion 9 pivots about axis 13, so that inlet opening 5 is arcuately displaced from its operative position in axial alignment with blow nozzle 17. This brings elbow portion 9 to the position generally indicated by phantom lines in the drawings.

The pivoting of elbow portion 9 simultaneously results in flange 16 of connection end 10 being disengaged from actuator pin 15 of switch 7. This permits actuator pin 15 to be extended from switch 7 to thereby generate a stop signal for stopping operation of feeder apparatus 3. The feeding of the fibre material or fibre strand 4 by means of blow nozzle 17 and calender rollers 18 is therefore discontinued.

As evident from FIG. 1, the pivoting of elbow portion 9 creates an open space upstream of inlet opening 5, permitting the fibre accumulation that has formed upstream of the inlet opening to be disentangled by itself as by dropping from inlet opening 5 by the action of gravity. Otherwise the fibre accumulation may be manually removed from inlet opening 5 of elbow portion 9.

After the fibre congestion has been cleared in this manner, elbow portion 9 may be pivoted back to its operative position indicated by solid lines, whereupon pipe conveyor installation 1 may be restarted.

From the description given above it is evident that the displacement of inlet opening 5 of conveyor pipe 2 away from feeder apparatus 3 and the simultaneous stopping of the operation of feeder apparatus 3 permits the occurrence of extended stoppage due to the formation of fibre congestions adjacent inlet opening 5 to be substantially avoided. The fibre congestion is prevented from backwards propagation in the direction of feeder apparatus 3, which would otherwise result in extended stoppage of the entire installation.

We claim:

1. A pneumatic pipe conveyor installation for fibres, particularly for textile fibre strands, comprising a conveyor pipe and a selectively operable feeder apparatus for feeding the fibres into said conveyor pipe, said conveyor pipe having a movable pipe section adjacent to the feeder apparatus, said pipe section having an inlet opening adjacent to the feeder apparatus, said inlet opening being at least partially surrounded by an annular flange having a pressure-receiving surface, said annular flange being operatively coupled to a switch for generating a stop signal for said feeder apparatus in response to pressure acting on said pressure-receiving surface, and said pipe section being adapted to move in response to a pressure acting on said pressure-receiving surface.

2. A pipe conveyor installation according to claim 1, wherein said pipe section includes a connection end, opposing said inlet opening, which is hingedly connected to the remainder of said conveyor pipe.

3. A pipe conveyor installation according to claim 2 wherein said connection end of said pipe section is formed to have an elbow portion and is provided with a pivot hinge having a substantially vertical pivot axis disposed at a lateral spacing from said inlet opening.

4. A pipe conveyor installation according to claim 3 wherein said elbow portion is disposed in a substantially horizontal plane.

5. A pipe conveyor installation according to claim 3 wherein said elbow portion encloses a substantially right angle.

6. A pipe conveyor installation according to claim 2 wherein the side of said connection end of said pipe section located substantially diametrically opposite said pivot axis is provided with a lock means adapted to open in response to a pressure acting on said pressure-receiving plate.

7. A pipe conveyor installation according to claim 6 wherein said lock means is of the magnetic type.

8. A pipe conveyor installation according to claim 2 wherein said switch for stopping the operation of said feeder apparatus is disposed adjacent said connection end of said pipe section and is a push switch operable in response to the pivotal displacement of said pipe section.

9. A pipe conveyor installation according to claim 1 wherein said feeder apparatus comprises a blow nozzle for blowing said fibres into said inlet opening of said conveyor pipe, said blow nozzle being disposed upstream of said inlet opening of said conveyor pipe substantially in axial alignment therewith.

10. A pipe conveyor installation according to claim 9 wherein said feeder apparatus includes a calendar roller pair disposes between said blow nozzle and said inlet opening of said conveyor pipe.

* * * * *